United States Patent [19]

Dretzka et al.

[11] 4,403,970

[45] Sep. 13, 1983

[54] MARINE PROPULSION UNIT HAVING IGNITION INTERRUPTION MEANS TO ASSIST TRANSMISSION SHIFTING

[75] Inventors: Robert G. Dretzka, South Milwaukee; James L. Holt, Bristol, both of Wis.; Guy D. Payne, Lake Villa, Ill.

[73] Assignee: Outboard Marine Corporation, Waukegan, Ill.

[21] Appl. No.: 288,469

[22] Filed: Jul. 30, 1981

[51] Int. Cl.[3] ..... B63H 23/08

[52] U.S. Cl. ..... 440/75; 123/335; 123/630; 192/0.062; 192/0.084; 440/86

[58] Field of Search ..... 440/86, 87, 75; 74/851, 74/852; 123/630, 335; 192/0.084, 0.02 R, 0.096, 0.062

[56] References Cited

U.S. PATENT DOCUMENTS

| | | | |
|---|---|---|---|
| 2,297,676 | 10/1942 | Elkin | 74/852 |
| 3,183,880 | 5/1965 | Shimanckas . | |
| 3,386,546 | 6/1968 | Yourich . | |
| 3,430,604 | 3/1969 | Pike et al. | 440/75 X |
| 3,601,103 | 8/1971 | Swiden | 123/335 |
| 3,665,903 | 5/1972 | Harris et al. | 123/335 |
| 3,842,788 | 10/1974 | Kroll . | |
| 3,858,101 | 12/1974 | Schmiedel et al. . | |
| 3,919,510 | 11/1975 | Barnes . | |
| 3,977,356 | 8/1976 | Kroll . | |
| 4,186,711 | 2/1980 | Jöerg | 123/630 X |
| 4,262,622 | 4/1981 | Dretzka et al. | 440/86 X |

*Primary Examiner*—Sherman D. Basinger
*Attorney, Agent, or Firm*—Robert E. Clemency

[57] ABSTRACT

Ignition pulses derived from an engine ignition coil primary are fed to the input of an ignition interruption circuit that employs an integrated circuit timer. The state of the output terminal of the timer is governed by an RC time constant circuit and by trigger signals supplied by a trigger circuit in response to occurrence of each ignition pulse. The timer output is coupled to the gate of an SCR which when it receives gate current as a result of the timer output being in a high state becomes conductive and bypasses ignition pulses to ground to thereby lower engine rpm to a preset minimum in which case gate current is removed and at least enough ignition pulses are allowed to be unbypassed for keeping the engine running above stalling speed. The timer, in effect, compares the interval between pulses with its time constant. When the intervals are longer than the time constant period the timer output remains low and provides no gate current, but when the opposite condition exists gate current is supplied until the intervals between ignition pulses equal or exceed the time constant period.

10 Claims, 10 Drawing Figures

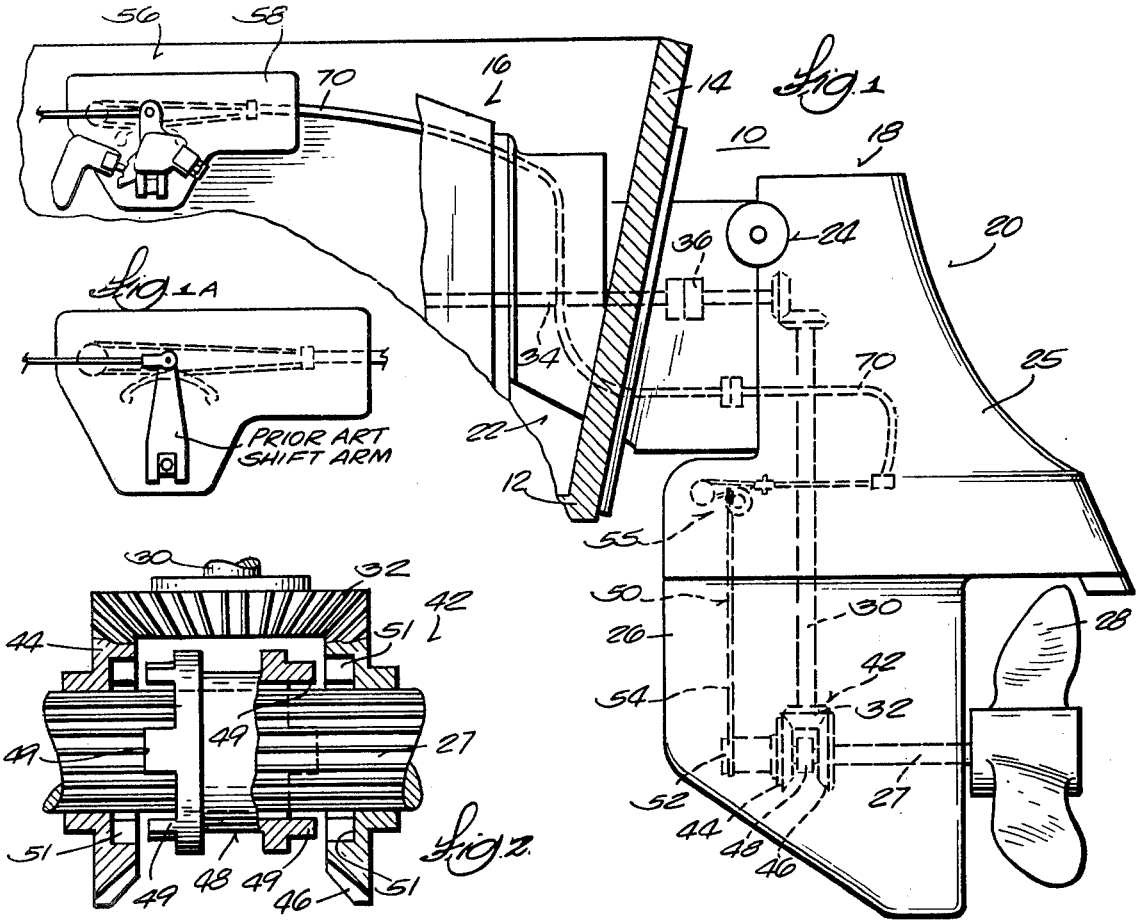
Fig. 1
Fig. 1A
PRIOR ART SHIFT ARM
Fig. 2
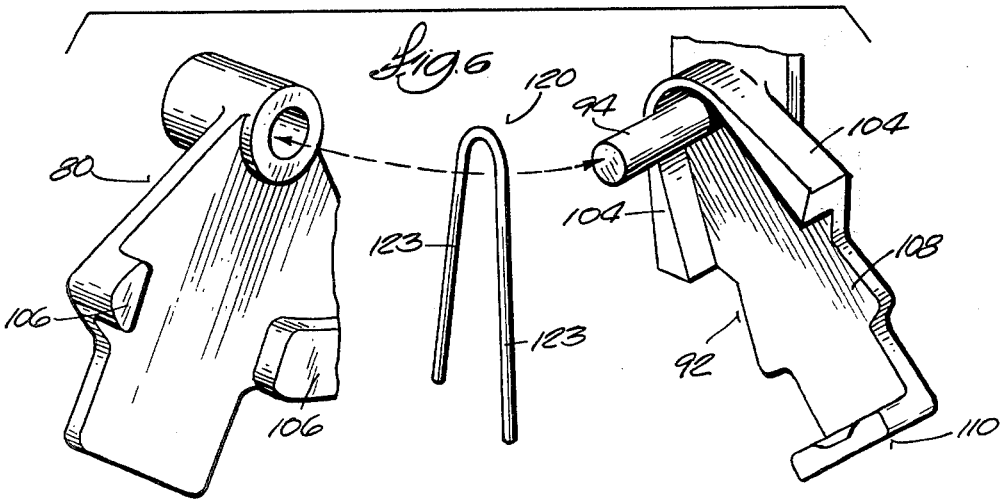
Fig. 6
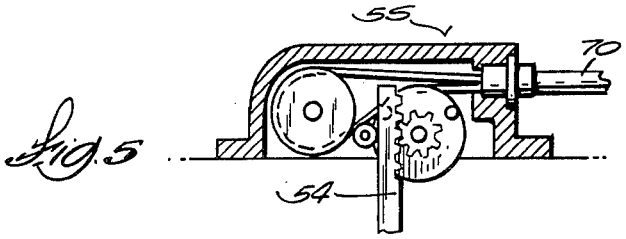
Fig. 5

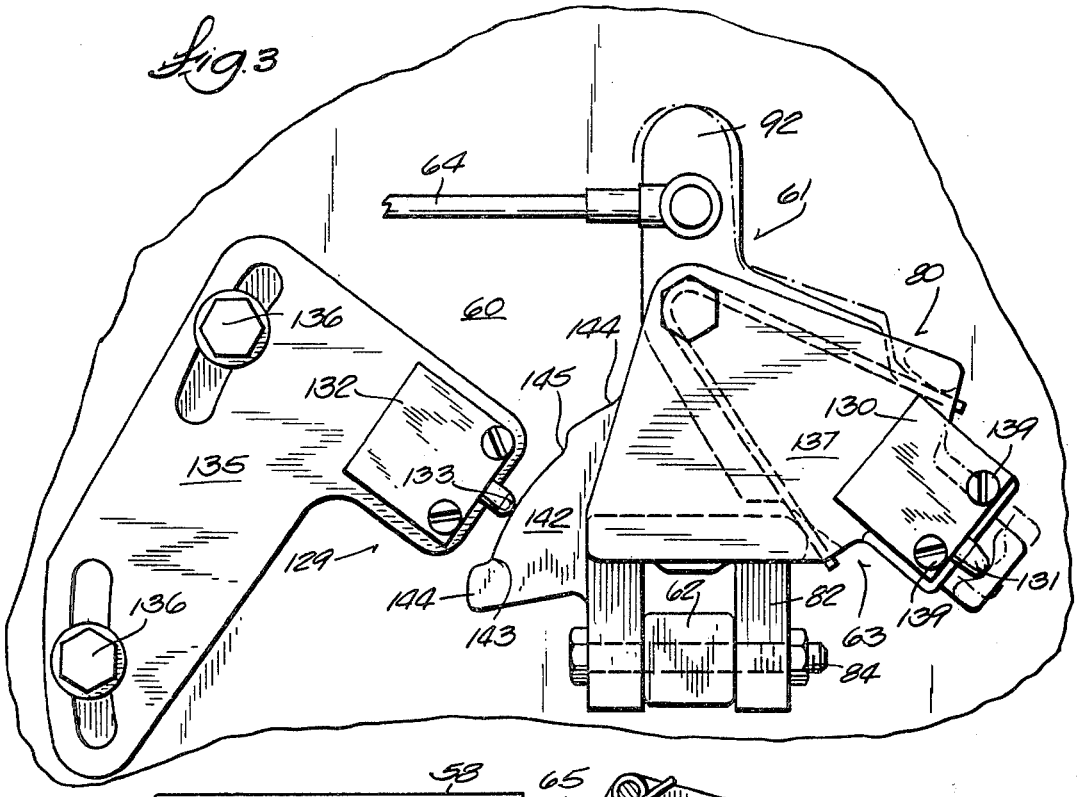
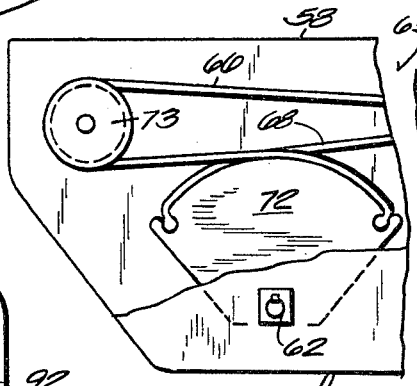
Fig. 4
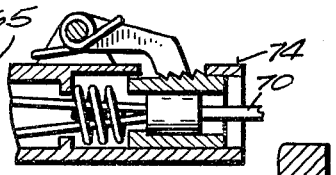
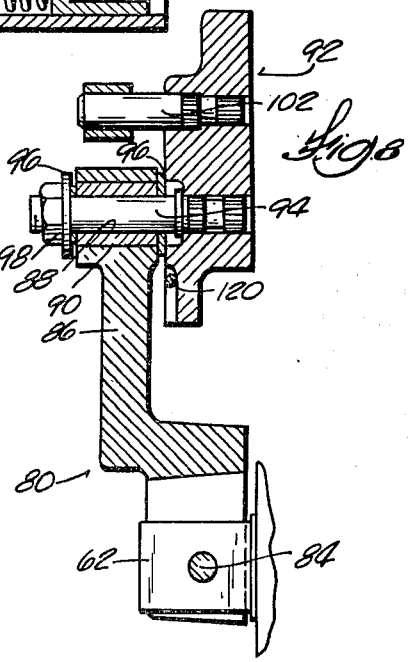
Fig. 8
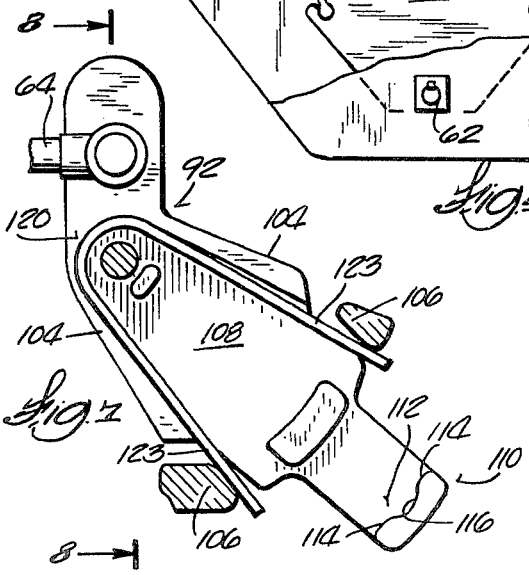
Fig. 7

MARINE PROPULSION UNIT HAVING IGNITION INTERRUPTION MEANS TO ASSIST TRANSMISSION SHIFTING

BACKGROUND OF THE INVENTION

This invention relates generally to marine propulsion devices such as stern drive units and outboard motors including a shifting mechanism and a reversing transmission for coupling the motor to the propeller. In particular, the invention disclosed herein is an electronic system for reducing engine speed to facilitate shifting the transmission.

For the sake of background, several U.S. patents which disclose marine propulsion devices having reversing transmissions and shifting mechanisms are U.S. Pat. Nos. 3,842,788; 3,183,880; 3,977,356; 3,386,546; 3,919,510; and 3,858,101.

Attention is also invited to pending U.S. patent application Ser. No. 890,499, now U.S. Pat. No. 4,231,316, which is assigned to the assignee of this application. The cited application discloses a mechanism for effecting shifting of a transmission. It also disclosed an electronic circuit for interrupting engine ignition periodically to thereby reduce engine speed during a shifting operation to ensure positive engagement of a driving element with a driven element during the shifting or propeller reversing operation. In the prior application, resistance to shifting, which is a concomitant of improper transmission engagement, is sensed. An electronic circuit responds to shifting resistance by going through a definite timing sequence which results in ignition being killed periodically to thereby lower engine speed sufficiently for the transmission elements to properly engage. A possible problem with the system is that it becomes committed to go through a particular ignition-killing sequence without accounting for all of the engine operating characteristic variables in which case there can be overkill and, hence, stalling of the motor.

SUMMARY OF THE INVENTION

In accordance with the invention, a new electronic circuit controls the ignition-off and ignition-on times by sensing actual engine rpm and establishing ignition-off as long as the rpm is above a predetermined set point and ignition-on as long as the rpm is below this set point. Thus the tendency of the engine to die completely under certain operating conditions when the ignition-off is a fixed time interval is eliminated since the ignition is automatically restored anytime the rpm falls below the set point. The electronic control, as will be seen, can be easily adapted to motors and ignition systems of different ratings.

The mechanism for sensing when resistance to clutch or transmission engagement is being encountered and which causes activation or inactivation of the new electronic engine speed control circuit can be the same as the mechanism described in the cited pending application so its structure and operation will be repeated herein only to the extent required. Other shifting resistance and shift mechanism position sensing could be used with the new control, however.

It may be noted that the concept of reducing engine speed to facilitate transmission shifting has been implemented, not only as in the cited application, but by other means as well. For example, in U.S. Pat. No. 2,297,676, issued to Elkin on Oct. 6, 1942 disclosed a circuit for grounding the ignition circuit and thereby reducing engine speed during a shifting operation. A thermally responsive grounding switch is used. If the shifting mechanism encounters no resistance the thermal response is to cause the switch to close and reduce engine speed whereas, if shifting cannot be accomplished within a predetermined time, the switch opens due to heating and the engine is restored to a speed corresponding with its throttle setting.

The main object of the present invention is to facilitate transmission shifting by means of an ignition interruption circuit that controls "ignition off" and "ignition on" times by sensing the actual rpm of a marine propulsion system engine and causing ignition to be off as long as engine rpm is above a predetermined set point and causing ignition to be on as long as the engine rpm is below the set point so that the engine will not drop down to a speed at which it might stall.

In accordance with the invention, when a manually actuated clutch element that engages the power input of the transmission to the power output encounters resistance to making full engagement due to high engine speed at the time of shifting, this condition is sensed and a grounding switch is closed in response to the condition existing. A semiconductor switch is connected to the ignition circuit and when its control gate receives current it bypasses ignition pulses through the grounding switch to ground. The ignition interruption circuit includes an RC timing circuit having a predetermined charging time constant or period. The timing circuit governs an integrated circuit timer. The timer compares the interval between ignition pulses with the predetermined time constant or period. The output terminal of the timer is coupled to the gate of the semiconductor switch. If, when the grounding switch is closed, the intervals between successive ignition pulses is longer than the timer period the output terminal of the timer switches to a logical low voltage state in which case no gate current is supplied to the semiconductor switch means and no ignition pulses are bypassed since the engine is running at or below predetermined minimum rpm. When the engine rpm is above minimum, the intervals between ignition pulses are shorter than the timer period and the timer output terminal remains in a high state to thereby supply gate current for turning the semiconductor switch on to thereby bypass sufficient ignition pulses to slow the engine to slightly below or at the predetermined set point.

DESCRIPTION OF THE DRAWINGS

FIG. 1 is a fragmentary partially schematic side elevational view of a typical boat-mounted stern drive unit with which the new shift facilitating circuit may be used;

FIG. 1*a* illustrates a prior art one-piece shift arm;

FIG. 2 is an enlarged partially sectional view of a transmission included in the stern drive unit shown in FIG. 1;

FIG. 3 is an enlarged fragmentary view of a shift assistance mechanism included in the shift means of the stern drive unit shown in FIG. 1;

FIG. 4 is a fragmentary view, with parts in section and parts broken away, illustrating a portion of pull-pull cable arrangement included in the shift means of the stern drive unit shown in FIG. 1;

FIG. 5 is an enlarged sectional view of the lower shift unit included in the shift means of the stern drive unit shown in FIG. 1;

FIG. 6 is an exploded fragmentary perspective view of the shift lever means included in the shift assistance mechanism shown in FIG. 3;

FIG. 7 is a fragmentary plan view, partially broken away, of the shift lever means shown in FIG. 6;

FIG. 8 is a section taken along a line corresponding with 8—8 in FIG. 7; and

DESCRIPTION OF A PREFERRED EMBODIMENT

Figure 9:
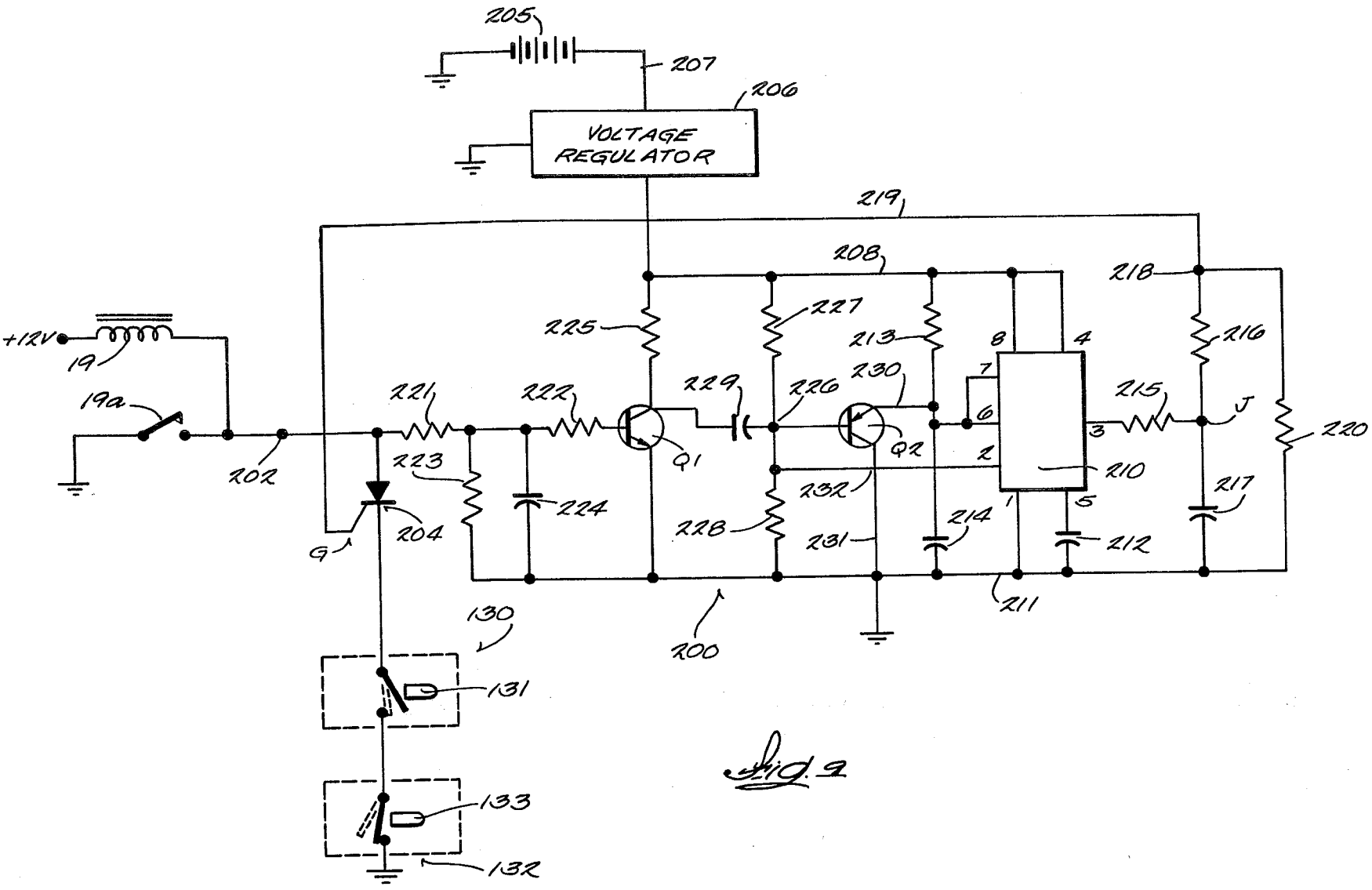
FIG. 9 is a schematic diagram of the new ignition interruption circuit.

For the sake of background, an illustrative marine propulsion system or stern drive until will be described and the reversible transmission and shift resistance sensing means will be described as well.

FIG. 1 shows a marine propulsion stern drive unit 10 mounted on a boat 12 having a transom 14. The stern drive unit 10 includes a fragmentarily shown engine 16 suitably mounted on the boat hull forwardly of the transom 14. A stern drive leg or propulsion leg 18 is fixedly attached to the engine 16 and includes a lower propulsion unit 20. Propulsion unit 20 is tiltable vertically about a horizontal axis and is swingable horizontally about a vertical axis relative to engine 16 for respectively changing the trim of the boat and for steering it.

Engine 16 may have one of the known ignition systems wherein a pulse is delivered through a primary coil with an electronic switch or by closing of breaker points to induce a high voltage in a secondary coil which is applied to the spark plug for effecting ignition of the fuel in the cylinders as the proper times for keeping the engine running. The ignition system components which are necessary for explaining the new control circuit will be discussed later in connection with FIG. 9 to the extent required. For the present time it is sufficient to recognize in FIG. 9 that the ignition system has a primary coil 19 and breaker points 19*a*. The coil is supplied from the battery, not shown, which is customarily on board the boat. As will be discussed more fully later, during dwell time, points 19*a* close and primary coil 19 becomes conductive. When the distributor points 19*a* open, a pulse is delivered to the input terminal 202 of the control circuit. As will appear, the ignition is selectively interrupted or rendered inoperative to prevent engine ignition when a grounding switch in the form of SCR 204 in FIG. 9 becomes conductive. This disables or shorts out one or more ignition pulses in sequence to lower engine speed to a predetermined level at which shifting is facilitated. As will appear, the new control circuit in FIG. 9 is inactivated and does nothing to reduce engine speed as long as the engine is being throttled to run at below a predetermined speed or as long as shifting resistance is not encountered.

Referring to FIG. 1, the propulsion unit 20 includes an exhaust housing 25 and a lower gearcase 26. Propeller shaft 27 is rotatably mounted in the gearcase and carries a propeller 28. Rotatably mounted within propulsion unit 20 is a drive shaft extending transversely of the propeller shaft 27 and carrying a bevel drive gear 32 on its lower end. Rotatably mounted within the intermediate unit 22 is an engine power output shaft 34 which is coupled to one end of the engine crank shaft, not shown, and is drivingly connected at the other end to the drive shaft 30 by way of a gear-type universal coupling 36. Vertical drive shaft 30 is preferably coupled to propeller shaft 27 through a reversing clutch or transmission which is generally designated by the numeral 42 and is shown in greater detail in FIG. 2.

The illustrative reversing transmission 42 includes a pair of axially spaced bevel gears 44 and 46 which are rotatable coaxially with and independently of propeller shaft 27 and mesh with the drive gear 32. Transmission 42 also includes a member for alternately engaging gear 46 or oppositely rotating gear 44 with propeller shaft 27 to thereby enable selecting the rotational direction of the propeller. The member takes the form of a clutch dog 48, as shown in FIG. 2, which is splined on the propeller shaft 27 between the bevel gears 44 and 46 for common rotation with propeller shaft 27 and for axial movement of the propeller shaft 27 between a central or neutral position in which it is shown and a forward drive position wherein it is moved to the left into engagement with bevel gear 44, and a reverse drive position wherein it is moved to the right of neutral position in full driven rotary engagement with the bevel gear 46.

Clutch dog 48 has one or more circumferentially spaced axially extending driving lugs 49 on its opposite ends. Driving lugs 49 are disposed for engaging or registering in complementary drive lugs 51 on each of the beveled gears 44 and 46. Thus, when clutch dog 48 is moved completely into one of the forward or reverse drive positions, lugs 49 at one end of the clutch dog become fully engaged with the axially adjacent complementary driving lugs 51 included in one of the bevel gears 44 or 46, and propeller shaft 26 is driven in either a forward or reverse direction depending on which bevel gear 44 or 46 is driving the clutch dog and, hence, the propeller shaft 27.

Clutch dog 48 is moved between neutral, forward drive and reverse drive positions by a known type of lower shift mechanism generally designated 50. The shift mechanism includes a shift actuator 52 which is operatively connected to clutch dog 48 and is mounted for common axial movement therewith relative to the propeller shaft 27 while affording rotation of the propeller shaft 27 relative to both the clutch dog 48 and the shift actuator 52. Shift mechanism 50 also includes an actuator rod 54 that is supported within propulsion unit 20 for reciprocal movement transversely of the propeller shaft 27 axis between the illustrated neutral positions in FIGS. 1 and 2 and forward and reverse drive positions. Actuating member 54 is connected to shift actuator 52 to effect axial movement of the shift actuator 52 and, thus, axial movement of clutch dog 48 relative to propeller shaft 27 in response to movement of the actuating rod 54 transversely of the propeller shaft axis. In the illustrated construction, downward movement of actuating rod 54 causes shaft actuator 52 to be moved to the left and upward movement causes shift actuator 52 to be moved to the right.

Selective movement of actuating rod 54 to shift transmission 42 is effected by the boat operator, as will be more fully explained, through lower shift unit generally designated by the numeral 55 and shows in FIG. 5 in detail. Lower shift unit 55 is mounted inside of the propulsion unit 20 at the junction between the exhaust housing 25 and the gearcase 26 and is mechanically connected to and is between the upper end of the actuating rod 54 and a shift converter unit which is generally designated by the numeral 56. The converter unit is located inside of the boat and preferably mounted on engine 16. Shift converter unit 56 includes a housing 58 and at least a portion of the shift assistance means, generally designated by the numeral 60 (see FIG. 3) including shift lever means, generally designated 61, affixed on a pulley segment shaft 62 which is rotatably mounted on the housing 58 for enabling rotational movement of the shift lever means relative to and exteriorly of housing 58. Shift lever means 61 is operably connected to a suitable operator positionable control including a push-pull cable 64 and a main control lever (now shown) and rotates in opposite directions from a neutral position in response to forward and backward force or movement of the push-pull cable 64 resulting from operation of the main control lever by the boat operator. The shift lever means 61 in FIG. 3 is shown in the neutral position and will be described in more detail later along with a further description of shift assistance means 60 which includes the ignition interruption circuit 200 shown in FIG. 9. First a general description of a pull-pull cable assembly will be given which completes the mechanisms or shift means required for shifting transmission 42 in response to operator movement of the push-pull cable 64.

A pull-pull cable assembly 65, as in FIG. 4, is provided for connecting the shift lever means 61 of FIG. 3 to the actuating rod 54. The connection is made by way of the lower shift unit 55. Actuating rod 54 moves vertically in response to rotational movement of the shaft 62 by the shift lever means. Vertical movements thereby displace shift actuator 52 and the connected clutch dog 48 in transmission 42.

As shown schematically in FIG. 4, cable assembly 65 comprises a flexible dual pull-pull type cable conduit assembly including first and second shift cables 66 and 68 which are covered by a flexible outer conduit or sheath 70 from which the cables extend. The cable assembly 65 extends through the interior of the intermediate unit 22 and through the propulsion unit 20 with one end of the sheath 70 being connected to the shift converter unit 56 and the other end being connected to the lower shift unit 55.

As illustrated, the shift converter unit 56 is a pulley segment 72 keyed for rotation with pulley segment shaft 62, and an idler pulley 73 are provided for connecting opposite ends of each of the shift cables 66 and 68 to the shift lever means 61 and to the upper end of actuating rod 54 so movement of one shift cable causes movement of the other shift cable in the opposite direction in which the cables always pull the load. As is evident, the rotational movement of shaft 62 and pulley segment 72 in one direction effects movement of actuating rod 54 and clutch dog 48 in one direction while rotational movement of shaft 62 in the other direction effects movements of actuating rod 54 and clutch dog 48 in the opposite direction.

Slack in the cables 66 and 68 resulting from stretching during use or from an accumulation of manufacturing tolerances at the time of assembly, could translate into lost motion in the shifting assembly. To reduce the effects of this possibility, cable tensioning means generally designated 74 in FIG. 4 is provided for preloading the cable assembly sheath 70 in a direction opposite of the pulling direction of the shift cables 66 and 68 as as to bow the sheath 70 and thereby maintain the cable taught.

The structure just described is provided for background. A more detailed discussion can be found in U.S. patent application Ser. No. 890,499 which is assigned to the assignee of this application.

Difficulty in shifting is occasionally encountered when the axial movement of the clutch dog 48 during transmission shifting results in a face-to-face or a corner drive condition with one of the transmission bevel gears. Referring to FIG. 2, the outer face of a clutch dog lug 49 can abut the outer face of a bevel gear lug 51, and the axial shift actuator for urging the clutch dog into engagement with a bevel gear as a result of an operator attempting to shift into a forward or a reverse drive position causes clutch dog 48 and a bevel gear to rotate together, with the clutch dog lugs and bevel gear lugs abutting or remaining in face-to-face contact, instead of being interdigitated, so as to prevent full engagement of the clutch dog with the bevel gear.

Thus, in a corner drive condition, lugs 52 of one of the bevel gears could drive the clutch dog lugs 49 with only the corners of the clutch dog and the driving bevel gears in contact. The bevel gear lugs transmit torque to the clutch lugs as a result of corner contact so that the clutch dog and driving bevel gear sometimes rotate together in the same relative angular position so the condition is maintained. In the corner drive condition, the circumferential forces on the clutch dog lugs due to the torque transmitted from the driving bevel gear acts on the driving corners of the clutch dog lugs to offset or resist the axial shift actuator shifting force which is trying to move the clutch dog into full engagement with a bevel gear. This condition is sometimes referred to as a "lock-out condition" which will be maintained as long as there is sufficient engine torque applied to driving bevel gear to keep the clutch dog and bevel gear rotating together.

To overcome the lock-out condition and to generally assist in transmission shifting, the previously mentioned shift assistance means 60 in FIG. 3 is provided. In addition to shift lever means 61 moving the pull-pull cable arrangement, the shift assistance means is provided to include the earlier mentioned ignition interruption circuit 200 for selectively interrupting the ignition of the engine to momentarily reduce engine torque so as to enable the lugs on the clutch dog and the driving bevel gear to fully interdigitate. In addition to overcoming the lock-out condition, the shift assistance means in FIG. 3 also assists axial movement of the clutch dog out of engagement with a bevel gear, since the reduction in engine torque and speed due to ignition interruption will reduce the forces exerted by the driving bevel gear lugs on the driven clutch dog lugs.

The shift assistance means 60 comprises a load sensing means, generally designated 63, which includes the shift lever means 61 and a switch 130, which when actuated, renders the ignition interruption circuit 200 in FIG. 9 operative for selectively interrupting ignition of the engine to thereby assist transmission shifting. Basically, load sensing means 63 senses the resistance, if any, by the clutch dog through the shift actuator force resulting from the clutch dog and a bevel gear not being fully engaged and the sensing means also senses resistance to withdrawal of the clutch dog from a bevel gear. Referring to FIG. 3, the shift lever means 61 comprises a mechanical lost motion assembly made up of upper and lower members 80 and 92 which interface with each other. These members are biased to maintain a normal angular relationship relative to each other. A switch 130 is located so that it will be actuated when the upper member 80 and lower member 92 are displaced from their normal relative angular relationship. The upper and lower shift lever members 80 and 92 are biased with a spring 120 so that a predetermined resistance to axial movement of clutch dog 48 during transmission shifting causes the bias to be overcome in which case the lower member 92 pivots relative to the upper member 80, thereby actuating switch 130.

The upper lever member 80 has a forked end 82 connected by a bolt 84 to pulley segment shaft 62 for rotation therewith and includes an upper end 86 having a bearing 88 mounted in an aperture 90. The lower member 92 is pivotally connected to the upper member 80 by a pivot stud 94 extending from the lower member through the bearing 88, the stud 94 being connected to the upper member by an arrangement including washers 96 and a lock nut 98. The lower member 92 also has a second pivot stud 102 spaced from the first pivot stud 94 and is connected to the operator controlled push-pull cable 64 as illustrated in FIG. 3. As can be seen most readily in FIGS. 6 and 7, the lower member 92 has an offset lower portion 108 which includes opposed and spaced retaining flanges 104 that cooperate with complementary stop flanges 106 depending from the upper member 80 to retain the U-shaped biasing spring 120 in a fixed position as will be discussed more fully below. The lower portion 108 also includes an end portion having an axially extending cam 110 on which there is an inner cam face 112 formed with raised edges or risers 114 and a central recess or depression 116.

U-shaped spring 120 has outwardly extending arms 123 which rest against the complementary retaining flanges 104 on lower member 92 and stop flanges 106 on upper member 80. As indicated earlier, spring 120 retains the upper and lower members 80 and 92 in a normal relative angular position when a shifting force is applied to the pivot stud 102 of the lower member 92 by the push-pull cable 64 so that both upper and lower members 80 and 92 rotate together normally with the pulley segment shaft 62. When the force for moving clutch dog 48 into or out of engagement with the driving bevel gears exceeds an upper limit and is transmitted to the pulley segment shaft 62 to resist rotation of upper member 80, continued force exerted by the push-pull cable 64 on the lower member 92 causes the flanges 104 and 106 to displace one of the arms 123 of the U-shaped spring 120 relative to the other arm, resulting in the lower member 92 pivoting with pivot stud 94 relative to upper member 80. Since the spring biases in both directions, the lower member 92 will pivot relative to the other member 80 in either direction, depending whether the operator controlled cable 64 is pulling or pushing on pivot stud 102 when excessive resistance to shifting is encountered.

If the engine torque and speed are low enough, a push or a pull force on lower member 92 by way of operator cable 64 rotates the lower member 92 coincident with the upper member 80 to effect rotation of the pulley segment shaft 62 and, hence, the clutch dog moves into full drive condition. If, however, a lock-out condition occurs when the cable 64 exerts a force on lower member 92 and shift resistance is excessive, the lower member 92 pivots relative to the upper member 80. This relative displacement actuates switch 130 which conditions the ignition interruption circuit 200 in FIG. 9 for reducing engine speed as required to enable the clutch dog to be shifted in full engagement with one or the other bevel gears in transmission 42 of FIG. 2.

In particular, switch 130 is normally open and has an actuator or plunger 131. The switch is mounted on a lower offset portion of the upper member 80 by screws 139 so the actuator 131 rests in the recess 114 of the cam 110 on low member 92 when the upper and lower members 80 and 92 are in their normal relative angular positions. Thus, when the lower member 92 pivots relative to the upper member in either direction, the actuator 131 of switch 130 is depressed by one of the risers or edges 114 of cam 110 as suggested by the phantom lines in FIG. 3.

As shown in FIG. 9, switch 130 is normally open when no resistance to transmission shifting is encountered. When resistance is encountered, however, plunger 131 is actuated in which case a circuit is completed from the cathode of SCR 204 to ground to thereby enable certain ignition pulses to be conducted to ground for the purpose of slowing down the engine. As will be explained in more detail later, the new engine speed sensing circuit means 200 in FIG. 9 senses engine speed and determine the periodicity at which ignition pulses are to be bypassed for bringing engine speed down to a preset value at which shifting of the clutch dog 48 can be accomplished easily. Before describing the new engine speed sensitive ignition interruption means of FIG. 9, another feature of the shift assistance means 60 requires discussion. It is a position sensing means, generally designated by the numeral 129 in FIG. 3. This means senses the true axial position of the clutch dog 48. The ignition interruption circuit 200 is responsive to the position sensing means for selectively controlling the ignition of the engine. More particularly, the position sensing means comprises a second switch 132 having an actuator 133 and a cam 142 which extends from the side portion of upper member 80. Switch 132 is mounted to an angularly adjustable bracket 135 which is connected to shift converter housing 58 with bolts 136. Cam 142 has an edge 143 with a central recess 145 and risers or edge portions 144 which actuate second switch 132 when the upper member 80 has rotated to a position corresponding to the clutch dog 48 having moved completely into one of the forward or reverse drive positions. Positions sensing means 129 could be used independently of the load-sensing means 63 and could be actuated at other points of travel of the clutch dog to control the ignition interruption circuit and engine ignition. In the preferred construction, however, position sensing means 129 includes the normally closed switch 132 which is actuated and senses extremes of movement of the upper member 80, and which is connected in series with switch 130 so as to be actuated to override the first switch 130 to terminate selective interruption of the engine ignition by the apparatus in FIG. 9. This override condition could result from excessive stroke of the push-pull cable 64, or from misadjustment of the neutral position of the shift lever means 61.

Now that known types of clutch dog position and resistance sensing means have been described, there is a proper background for describing the new engine speed sensitive ignition interruption circuit in FIG. 9. To recapitulate, during normal operation of the boat's engine, distributor points **19*a* are opened and closed successively by the distributor rotor cam, not shown, and high voltage pulses are delivered from the secondary winding, not shown, of ignition coil 19 to the engine spark plugs in a conventional manner for an internal combustion engine. When distributor points 19*a* open, coil 19 is disconnected from ground and a current pulse is delivered to input terminal 202 of ignition interruption circuit 200. These pulses are not effectively processed by the ignition interruption circuit normally. However, when shifting of the clutch dog is resisted and engine speed must be lowered to permit complete engagement of the clutch dog with a bevel gear in the transmission, the clutch dog resistance is sensed as has been described and normally open switch 130 closes, the ignition interruption circuit becomes operative to bypass some of the ignition pulses to ground to thereby lower engine speed to a preset level which is high enough to prevent the engine from stalling but low enough to facilitate shifting of the clutch dog into full engagement. The ignition interruption circuit 200 is operative to cause selective conduction of ignition pulses to ground by controlling a silicon controlled rectifier (SCR) 204 which is represented by the standard symbol and it comprises an anode, a cathode and a control gate. The ignition interruption circuit applies positive pulses to the control gate for turning on SCR 204 and grounding ignition pulses provided load sensitive switch and clutch position sensitive switch 132 are closed. If these switches are both open, the boat engine simply runs at a speed corresponding with its carburetor throttle setting even through positive signals may be applied to the turn-on gate of SCR 204**.

Electric power for the electronic circuitry in FIG. 9 is derived from the on-board battery 205 which is nominally a 12 V battery. The output of battery 205 is input to a voltage regulator 206 which, by way of example and not limitation, provides a regulated output voltage of 8.2 volts on electronic circuit supply line 207. This line connects to a positive bus 208 on a printed circuit board, not shown.

An integrated circuit timer 210 is an important element in the ignition interruption circuit of FIG. 9. By way of example, a type 555 timer has been used. Timer 210 may be looked upon as being a rate comparator. It compares the ignition pulse rate with the time constant or charging rate of a timing circuit. The ignition pulse rate is indicative of engine speed. When engine speed is below a preset rate, clutch dog or transmission shifting if elected at that time, would not be impeded and the timer would permit all ignition pulses to be supplied to the engine spark plugs and the engine would run at a speed determined by its carburetor throttle. If the engine is running at a speed above the preset or predetermined minimum speed required to prevent stalling and shifting is impeded, timer 210 becomes operative to interrupt or omit some of the ignition pulses by grounding to slow the engine down to no less than a predetermined minimum rpm to facilitate shifting. As will be evident later, the timer permits some percentage of ignition pulses to be supplied to the engine spark plug as the engine speed is being reduced to further prevent engine stalling problems.

Timer 210 has its pins 4 and 8 connected to positive voltage supply bus 208. Pin 1 of the timer connects to the negative supply line or ground 211. Pin 5 is connected to the negative supply through a capacitor 212 since pin 5 is not used for any purpose in the circuit.

Timer 210 is associated with an RC time constant circuit comprised of a high value resistor 213 in a series circuit with a timing capacitor 214. The timing circuit is connected between positive supply bus 208 and negative or grounded line 211. Resistor 213 and, hence, the time constant, may have different values when the interrupter is used with different engines. Resistor 213 is selected for compatibility with a 2, 4, 6, or 8-cylinder engine, for example, which each have a different ignition pulse rate when running at the same speed. Thus, resistor 213 is chosen to establish a minimum speed above which killing the ignition or starting to eliminate some of the ignition pulses to reduce engine speed will occur. As is known, pins 6 and 7 of timer 210 are the threshold voltage sense pin and capacitor discharge pin. When timing capacitor 214 is charged to about two-thirds of the voltage between lines 208 and 211, threshold has been reached and this is sensed on pin 6. When capacitor 214 is charging, out-put pin 3 of timer 210 is in its high voltage state, that is, near the voltage which exists between bus 208 and negative line 211. When threshold level is sensed on pin 6, capacitor C5 is discharged through pin 7 of timer 210 and output pin 3 switches to a low state close to negative line 211 potential. Capacitor 214 can continue to discharge through pin 7 and output pin 3 will remain in its low state until the timer is retriggered by its trigger pin 2 having a negative going pulse applied to it. Thus, in the absence of any other circuitry, capacitor 214 would charge, output pin 3 would be high during the charging interval, threshold would be sensed, capacitor 214 would discharge, and output pin 3 would go low and remain low until a negative going reset pulse were applied to pin 2.

Output pin 3 of timer 210 connects through a relatively low value resistor 215 to a junction point J which is intermediate a resistor 216 and a capacitor 217. The top 218 of resistor 216 is connected by way of a line 219 to the gate terminal G of SCR 204. Under circumstances which will be described, output current from pin 3 is the gate current supply to SCR 204 for turning the SCR on as required and in the proper phase relationship to reduce engine speed to facilitate transmission shifting. It is to be noted that a resistor 220 is connected across what may be considered to be a time delay circuit comprised of resistor 216 and capacitor 217 for discharging capacitor 217 under certain circumstances. The value of resistor 220, however, is substantially higher than the value of registor 216 so that normally current pulses can be delivered through the latter to the gate of the SCR.

Consider now the ignition pulse input to the circuit. Every time the distributor breaker points 19*a* open to cause an ignition pulse, a corresponding pulse is delivered to input terminal 202 at the left region of the circuit in FIG. 9. This occurs at any time the engine is running. Each pulse is conducted through a current limiting resistor 221 and another resistor 222 to the base of a transistor Q1. Every time an ignition pulse occurs, transistor Q1 turns on with effects that will be explained. A resistor 223 in parallel with a capacitor 224 constitutes a filter circuit which eliminates contact bounce or double triggering of transistor Q1 which might otherwise result from the unsmooth or multiple peaked wave shape of the ignition pulses.

The collector circuit of transistor Q1 is supplied by way of a collector resistor 225 from power supply bus 208. Every time transistor Q1 is pulsed or triggered on momentarily, another transistor, Q2, is also turned on to discharge timing capacitor 214 associated with timer 210. Q2 is normally biased to an off state by a voltage developed at an intermediate point 226 in a voltage divider circuit comprised of resistors 227 and 228 which are serially connected between positive bus 208 and negative line 211. The collector of Q1 is coupled to the intermediate point 226 of the voltage divider and, hence, to the base of transistor Q2 through a capacitor 229. During the intervals between ignition pulses, when Q1 is turned off, capacitor 229 charges through the series circuit beginning at positive bus 208 and extending through resistor 225, capacitor 229 and resistor 228. Thus, during the interpulse intervals, the left plate on capacitor 229 is positively charged and the right plate is negative. When transistor Q1 is pulsed into a conductive state, the left plate of capacitor 229 is effectively connected to ground or to the negative line terminal and this negative going pulse appears at point 226 and the base of transistor Q2. The result is that the emitter-base circuit of transistor Q2 is then forward biased by the voltage on timing capacitor 214. This turns transistor Q2 on and results in discharge of timing capacitor 214 through the emitter line 230 of transistor Q2 and its collector line 231 which connects to grounded negative line 211. Thus, it will be seen that regardless of whether shifting is attempted or not, every ignition pulse will cause timing capacitor 214 to discharge to near ground potential because of the low impedance in the circuit through transistor Q2.

The repetitiously occuring negative going pulses at point 226 make the top of resistor 228 negative every time an ignition pulse occurs. This negative going pulse is coupled by way of line 232 to trigger pin 2 of timer 210. Timer 210 responds to a negative trigger pulse if the timer 210 has timed out by allowing capacitor 214 to begin to charge again. If the timer 210 has not timed out, then the negative trigger pulse has no effect. When ignition pulses are coming in at a slow enough rate, timer 210 will have time to time out. That is, capacitor 214 will have time to reach threshold voltage after which output pin 3 of the timer will switch to its low state and stay there until a negative trigger pulse is applied to trigger pin 2 of the timer.

Now that all of the parts of the ignition interruption circuit have been identified, its overall function will be examined. There are several engine speed ranges or conditions to which the ignition interruption circuit responds differently. Consider first the case where the engine is running at a speed below the set point in which case no ignition interruption nor slowing of the engine needs to be done since shifting of the clutch into full engagement can be accomplished without resistance. Under these conditions capacitor 214 will begin to recharge and output pin 3 of timer 210 will go high with every incoming ignition pulse because the timer is triggered by a negative going pulse on its pin 2 each time an ignition pulse occurs. Since the ignition pulses are coming in at a slow rate, the voltage on capacitor 214 will reach threshold between ignition pulses and the timer will time out. That is, capacitor 214 will be discharged every time thru discharge pin 7 of the timer. Output pin 3 will go high at the beginning of the capacitor 214 charging interval and delay capacitor 217 in the output circuit will begin to charge at the same time. During the time delay capacitor 217 is being charged, no gate current is supplied to the SCR 204. Thus a normal ignition pulse is supplied to the spark plug of the engine. A short time later, when pin 6 of timer 210 senses threshold voltage on capacitor 214, output pin 3 of the timer changes to its low state and capacitor 214 discharges through pin 7. At this time, since output pin 3 has switched low, shortly thereafter, the top of capacitor 217 or junction point J will go low. When point J goes low, there is no gate current for SCR 204 and it remains nonconductive. Timing capacitor 214 cannot begin to recharge until the next ignition pulses is delivered at which time pin 2 of the timer 210 will go low or negative to trigger it and let the timing capacitor 214 begin to recharge. Pin 3 then goes high again, the cycle repeats, and since no ignition pulses are being sent to ground, the engine runs at below set point rpm determined by throttle setting.

When the next ignition pulse occurs, the process just described repeats. That is, transistors Q1 and Q2 turn on and a trigger pulse is supplied to the timer 210. Recycling occurs since the timer has timed out and pin 3 is low and the timer is just waiting for a trigger pulse on pin 2. While waiting, timing capacitor 214 continues to remain discharged through pin 7. When the trigger pulse occurs, output pin 3 of the timer 210 goes high again as timing capacitor 214 begins to charge. However, junction point J on delay capacitor 217 does not go high immediately but waits until capacitor 217 becomes charged. Thus, no gate current is supplied to the SCR 204 and a normal ignition pulse is supplied to the spark plug of the engine. The SCR 204 is supplied gate current when capacitor 217 has charged but the ignition pulse has already occurred by this time. Stated in another way, delay capacitor 217 charges and the SCR gate is enabled but that occurs between ignition pulses. Thus the engine runs in a normal fashion. The operation just repeats itself again and again and the engine continues running in accordance with the throttle setting.

As previously stated, capacitor 217 does not hold high during the entire interval between ignition pulses coming in at lower than set rate but discharges through the loop comprised of resistors 216 and 220. The reason for the discharge circuit is that capacitor 217 must be charged when the next ignition pulse occurs to create the delay that was mentioned earlier. Otherwise, every time a trigger pulse occurred, pin 3 of timer 210 would go high and every ignition pulse would be shorted to ground by way of SCR 204. Thus, in the case under discussion, all the ignition pulses will come through to enable the engine to run at throttle speed to preclude stalling.

Now assume that the engine is running at a high rate of speed and transmission shifting is undertaken and resistance is encountered such as to again close load sensing switch 130 while clutch position sensing switch 132 is also closed. Consider, for instance, that the set minimum engine speed for the case just discussed resulted in an ignition pulse rate of 40 Hz, by way of example and not limitation, and that the case to be considered now is one where ignition pulses are occurring at 60 Hz for example. In this case, substantially the same timing action would occur but the timer 210 would never have time to time out. Pin 3 would remain high. The reason is that ignition pulses are coming in at such a fast rate that timing capacitor 214 would always be discharged through transistor Q2 long before threshold is reached. This would result from the fact that timing capacitor 214 is discharged by Q2 in response to occurrence of every ignition pulse. Since threshold is not reached, output pin 3 of the timer would stay high while timing capacitor 214 is attempting to charge and delay capacitor 217 would stay charged. On first impression, it would appear that with gate current now being constantly applied to SCR 204 as a result of pin 3 and delay capacitor 217 staying high that all of the ignition pulses would be bypassed to ground through the SCR. What actually happens, however, is that the negating or grounding of some of the ignition pulses results in the engine losing speed in which case it will drop down to below the set point due to momentum of the engine. However, ignition pulses are still applied to the input of the interrupt circuit because of the voltage drop across the SCR 204. When the engine rpm drops below the set point, the timer will time out and ignition pulses will then be supplied to the spark plugs of the engine as described before for operation below the set point. The engine rpm will then increase towards throttle setting but when the rpm exceeds the set point the timer will again not time out and SCR 204 will again remain turned on until the engine speed drops to or below the set point. In the actual embodiment, it has been found that engine speed drops below the set point by a small amount actually due to engine momentum. When slightly below set point speed is reached, the time constant of the resistor 213 and capacitor 214 timing circuit is shorter than the interval between ignition pulses. Thus, timing capacitor 214 charges to threshold and discharges. Output pin 3 remains high until threshold is reached on timing capacitor 214 and then goes low. The next ignition pulse retriggers the timer 210 as described above and output pin 3 goes high. But capacitor 217 does not go high immediately since it must charge up. That is what allows the next ignition pulse to come through. Again, after timing capacitor 214 discharges to about $\frac{1}{3}$ of supply voltage, the output pin 3 of timer 210 switches to its low state so current is removed from the gate of SCR 204. When the next ignition pulse occurs, reset pin 2 of the timer again receives a coincident negative going trigger pulse which results in timing capacitor 214 beginning to charge again. The action continues to the given engine throttle setting such that the engine will drop a little below set point speed to cause the SCR to turn off and then the engine spark plug or plugs will fire to pick up speed for several revolutions until set point is exceeded again and the SCR turns on. Thus, the engine is maintained in a range between a little above and very little below set point speed.

On some occasions, shifting of the clutch dog in the transmission will be resisted while the throttle is set to cause the engine to run at an intermediate speed. For instance, let us say that at set point speed the ignition pulse rate is 40 Hz and the speed above intermediate corresponds to an ignition pulse rate of about 60 Hz. Now assume an engine speed existing at the time shifting is desired that produces ignition pulses at a rate of about 45 Hz. Under these circumstances, sometimes timing capacitor 214 will have a chance to build up to threshold during one of the ignition interpulse intervals and on the next one it may not due to variation in dwell time from one ignition pulse to the next. The effect is that one ignition pulse is allowed to come through periodically. For instance, every other one or every third one might come through. In any case, the number of pulses that come through or the number of times that SCR 204 is rendered nonconductive and the time between these events provides a buffer zone that helps prevent engine stalling.

The ignition pulse rates given above are chosen just for obtaining the clarity that results from using numerical values which can be easily compared. As indicated earlier, however, the ignition pulse rates associated with keeping various engines running at above stalling speed will differ. Thus, the value of resistor 213 will be chosen to establish the set point or minimum engine speed that is appropriate for a particular engine.

It is desirable to inactivate the ignition interruption circuit when the engine is running at high speed at which time shifting would not normally be desired anyway. Referring to FIG. 3 again, it will be noted that when there is an overstroke delivered by cable 64, cam 142 will rotate to the point where one of its risers 144 will depress switch actuator 133 for opening normally closed switch 132. As can be seen in FIG. 9, this opens the circuit from the cathode of SCR 204 to ground even though the other load sensing switch 130 might be closed. Thus, when position sensing switch 132 is opened, SCR 204 will not be conductive for negating any ignition pulses even though it is enabled by reason of its gate receiving current from the ignition interruption circuit output.

Although an illustrative embodiment of an engine ignition pulse rate comparator and ignition pulse negating circuit has been described in detail, such description is intended to be illustrative rather than limiting, for the invention may be variously embodied and is to be limited only by interpretation of the claims which follow.

We claim:

1. An ignition interruption circuit for facilitating transmission shifting by reducing the speed of an internal combustion engine having an ignition circuit and included in a marine propulsion system comprising a propeller shaft, and a transmission having power input means coupled to the engine, power output means coupled to the propeller shaft, and a clutch element shiftable from an inactive neutral position to an active position for engaging the power input means with the power output means, said ignition interruption circuit comprising input means for receiving ignition pulses from said ignition system, a series circuit between said input means and ground, normally open switch means in said series circuit, said normally open switch means being closeable in responsive to resistance to shifting so as to enable engine speed reduction, semiconductor switch means in said series circuit and having a control gate which, when energized, closes said semiconductor switch means to enable bypassing conduction of ignition pulses to ground when said normally open switch means is closed, power input terminals connected respectively between the positive side and the negative side/ground of a dc source for energizing said gate, an RC timing circuit including timing resistor means and timing capacitor means connected in series with each other and to said power input terminals, said timing circuit having a predetermined charging time constant period, a first transistor having a load circuit connected between ground and the junction of said timing capacitor and said timing resistor means, trigger circuit means having input means coupled to said ignition pulse input means, said trigger circuit means being responsive to the occurrence of each ignition pulse by triggering said first transistor into conduction so as thereby to discharge said timing capacitor and to provide a trigger signal to start a new timing period coincident with said timing capacitor beginning to recharge, said trigger circuit means including a second transistor having a base coupled to said ignition pulse input means, an emitter connected to ground, and a collector for coupling to the positive side of said dc source, said second transistor becoming conductive in response to each incoming ignition pulse, a voltage divider comprising first and second resistors in series, said first resistor being connected to the positive side of the dc source and said second resistor being connected to ground, a coupling capacitor connected between said collector of said second transistor and the junction point between said first and second resistors, said junction point also being connected to said first transistor, said coupling capacitor charging positively on the side connected to said collector of said second transistor when nonconductive between ignition pulses, and said coupling capacitor discharging through said second transistor upon occurrence of an ignition pulse to thereby provide at said junction point a negative going pulse, timer means for comparing the intervals between ignition pulses with the time constant period, said timer means having a threshold voltage sensing terminal connected to the junction between said timing capacitor and timing resistor means, a capacitor discharge terminal connected to the junction between said timing capacitor and timing resistor means, said timer means also having an output terminal coupled to said control gate of said semiconductor switch means, and a trigger signal input terminal, said timer means responding to input of a trigger signal by initiating a new timing period, said timer means being responsive to the interval between successive ignition pulses being lower than the time constant period as a result of said engine running at or below a predetermined speed by switching said output terminal to a deenergized state to thereby prevent said semiconductor switch means from bypassing the pulses to ground, and said timer means being responsive to said intervals being shorter than said time constant period by switching said output terminal to an energized state and to thereby energize said gate to cause said semiconductor switch means to selectively bypass ignition pulses to ground and consequently reduce the engine speed, said timer means having the properties of switching said output terminal to a logical high voltage state while said timing capacitor is charging, initiating discharge of said timing capacitor through said capacitor discharge terminal and simultaneously switching said output terminal to a logical low state when said threshold voltage is reached to define the end of the timing period, and maintaining said output terminal in a logical low state until a trigger signal is coupled to said trigger signal terminal, and a delay circuit comprising a delay resistor and a delay capacitor in series, the junction thereof being coupled to said timer means output terminal, said delay capacitor being connected to ground and said delay resistor being coupled to said gate, said delay capacitor discharging each time said timer output terminal switches to its logical low state and said delay capacitor remaining charged during a sequence of ignition pulses corresponding to engine speed above said predetermined speed during which time said output terminal remains high to energize said gate, and when said engine speed reduces to below said predetermined speed due to one or more ignition pulses having been bypassed such that, when said output terminal is switched high again, said delay capacitor will effect a delay while recharging for permitting one or more ignition pulses to be additionally unbypassed so that said engine speed will increase to or slightly above said predetermined speed to avoid stalling.

2. The ignition interruption circuit defined in claim 1 including a resistor connected in parallel with said delay circuit.

3. The ignition interruption circuit defined in claim 1 wherein said timer means is a type 555 integrated circuit timer.

4. An ignition interruption circuit as set forth in any of claims 2, 3 or 1 wherein the time constant period of said timing circuit is determined by the values of said timing resistor or said timing capacitor or the combination thereof and the values are chosen to provide a time constant period coordinated with the ignition pulse rate of a particular engine as determined by the number of cylinders in the engine.

5. An ignition interruption circuit for facilitating transmission shifting by reducing the speed of an internal combustion engine having an ignition circuit and included in a marine propulsion system comprising a propeller shaft, and a transmission having power input means coupled to the engine, power output means coupled to the propeller shaft, and a clutch element shiftable from an inactive neutral position to an active position for engaging the power input means with the power output means, said ignition interruption circuit comprising input means for receiving ignition pulses from said ignition system, a series circuit between said input means and ground, semiconductor switch means in said series circuit and having a control gate which, when energized, closes said semiconductor switch means to enable bypassing conduction of ignition pulses to ground, normally open switch means in said series circuit, said normally open switch means being closeable in responsive to resistance to shifting so as to enable engine speed reduction when said semiconductor switch is closed, a normally closed switch means in said series circuit, means for opening said normally closed switch means in response to the clutch element having effected complete engagement of the power input means to the power output means to thereby prevent said semiconductor switch means from bypassing any ignition pulses, power input terminals connected respectively between the positive side and the negative side/ground of a dc source for energizing said gate, an RC timing circuit including timing resistor means and timing capacitor means connected in series with each other and to said power input terminals, said timing circuit having a predetermined charging time constant period, and timer means for comparing the intervals between ignition pulses with the time constant period, said timer means having an output terminal coupled to said control gate of said semiconductor switch means, said timer means being responsive to the interval between successive ignition pulses being longer than the time constant period as a result of said engine running at or below a predetermined speed by switching said output terminal to a deenergized state to thereby prevent said semiconductor switch means from bypassing the pulses to ground, and said timer means being responsive to said intervals being shorter than said time constant period by switching said output terminal to an energized state and to thereby energize said gate to cause said semiconductor switch means to selectively bypass ignition pulses to ground and consequently reduce the engine speed.

6. An ignition interruption circuit in accordance with claim 5 wherein said timer means has a threshold voltage sensing terminal connected to the junction between said timing resistor means and said timing capacitor, and a capacitor discharge terminal connected to the junction between said timing resistor means and said timing capacitor, said timer means also having an output terminal coupled to said control gate and having a trigger signal input terminal, said timer means responding to input of a trigger signal by initiating a new timing period, a first transistor having a load circuit connected between ground and the junction of said timing capacitor and said timing resistor means, trigger circuit means having input means coupled to said pulse input means, said trigger circuit means being responsive to occurrence of each ignition pulse by triggering said first timing capacitor into conduction to thereby discharge said timing capacitor and to provide a trigger signal to start said new timing period coincident with said timing capacitor beginning to recharge, said timer means having the properties of switching said output terminal to a logical high voltage state while said timing capacitor is charging, initiating discharge of said timing capacitor through said capacitor discharge terminal and simultaneously switching said output terminal to a logical low state when said threshold voltage is reached to define the end of the timing period, and maintaining said output terminal in a logical low state until a trigger signal is coupled to said trigger signal terminal, a delay circuit comprising a delay resistor and a delay capacitor in series, the junction thereof being coupled to said timer means output terminal, said delay capacitor being connected to ground and said delay resistor being coupled to said gate, said delay capacitor discharging each time said timer output terminal switches to its logical low state and said delay capacitor remaining charged during a sequence of ignition pulses corresponding to engine speed above said predetermined speed during which time said output terminal remains high to energize said gate, and when said engine speed reduces to below said predetermined speed due to one or more ignition pulses having been bypassed such that, when said output terminal is switched high again, said delay capacitor will effect a delay while recharging for permitting one or more ignition pulses to be additionally unbypassed so that said engine speed will increase to or slightly above said predetermined speed to avoid stalling.

7. An ignition interruption circuit as set forth in claim 6 including a resistor connected in parallel with said delay circuit.

8. An ignition interruption circuit as set forth in claim 6 wherein said timer means is a type 555 integrated circuit timer.

9. An ignition interruption circuit as set forth in any of claims 5, 6, 7 or 8 wherein the time constant period of said timing circuit is determined by the values of said timing resistor or said timing capacitor or the combination thereof and the values are chosen to provide a time constant period coordinated with the ignition pulse rate of a particular engine as determined by the number of cylinders in the engine.

10. An ignition interruption circuit for facilitating transmission shifting by reducing the speed of an internal combustion engine having an ignition circuit and included in a marine propulsion system comprising a propeller shaft, and a transmission having power input means coupled to the engine, power output means coupled to the propeller shaft, and a clutch element shiftable from an inactive neutral position to an active position for engaging the power input means with the power output means, said ignition interruption circuit comprising input means for receiving ignition pulses from said ignition system, a series circuit between said input means and ground, semiconductor switch means in said series circuit and having a control gate which, when energized, closes said semiconductor switch means to enable bypassing conduction of ignition pulses to ground, means for energizing said gate in response to engine speed above a predetermined speed, a normally open switch connected in said series circuit, means responsive to resistance to transmission shifting for closing said normally open switch to enable passage to ground of ignition pulses when said semiconductor switch means is closed, thereby to reduce engine speed, a normally closed switch in said series circuit, and means for opening said normally closed switch in response to the clutch element having effected complete engagement of the power input means to the power output means to thereby prevent said semiconductor switch means from bypassing any ignition pulses.

* * * * *